United States Patent [19]

Dweck

[11] Patent Number: 5,008,869

[45] Date of Patent: Apr. 16, 1991

[54] TRANSPARENT DIAL FACE WATCH WITH REPLACEABLE VISUAL DISPLAY

[75] Inventor: Mark Dweck, Great Neck, N.Y.

[73] Assignee: Colony Corporation, Scarsdale, N.Y.

[21] Appl. No.: 507,951

[22] Filed: Apr. 11, 1990

[51] Int. Cl.[5] ..... G04B 19/06; G04B 19/04

[52] U.S. Cl. ..... 368/228; 368/242

[58] Field of Search ..... 368/223-242

[56] References Cited

U.S. PATENT DOCUMENTS

| | | | |
|---|---|---|---|
| 3,111,003 | 11/1963 | Droz | 368/223 |
| 4,660,992 | 4/1987 | Paul et al. | 368/223 |

FOREIGN PATENT DOCUMENTS

| | | | |
|---|---|---|---|
| 209814 | 11/1959 | Fed. Rep. of Germany | 368/223 |
| 2588975 | 4/1987 | France | 368/223 |
| 2614443 | 10/1988 | France | 368/223 |

*Primary Examiner*—Bernard Roskoski

*Attorney, Agent, or Firm*—Henry R. Lerner

[57] ABSTRACT

A watch is constructed with a front transparent dial face for displaying the time, such as a liquid crystal, a rear watch mechanism for controlling the display of visually perceptive indicia of the time in the transparent dial face, and an interior hollow compartment located between the front transparent dial face and rear watch mechanism. A visual display of the user's choice, such as a photograph, can be inserted by the user into the compartment in juxtaposed relation to the transparent dial face and is observable to the eye through the transparent dial face simultaneously with the time display. The visual display can be inserted into the compartment by itself, or can be positioned on a plate or tray and then slid or pivoted into the compartment. Means are provided to secure the visual display in place after insertion into the compartment.

20 Claims, 3 Drawing Sheets

FIG. 1
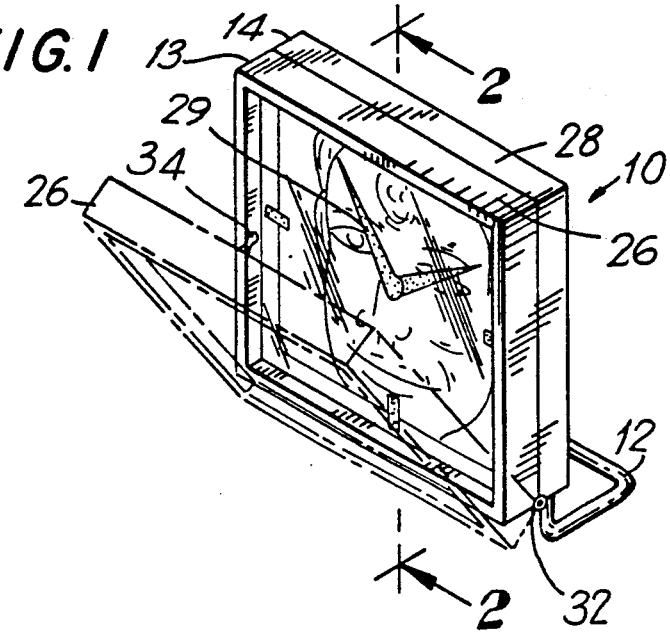
FIG. 2
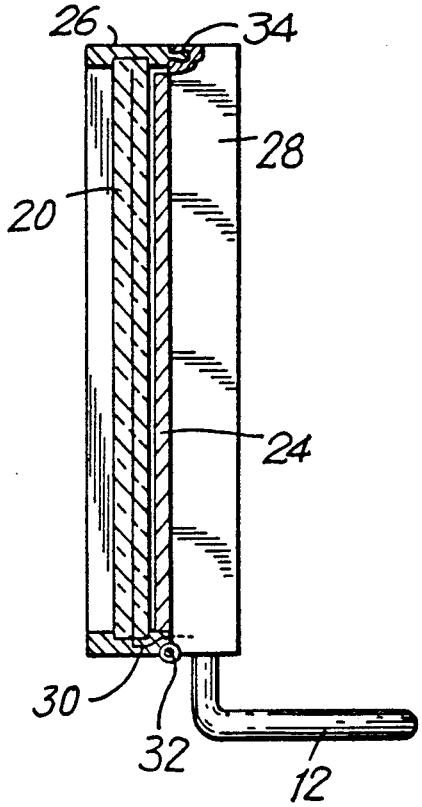
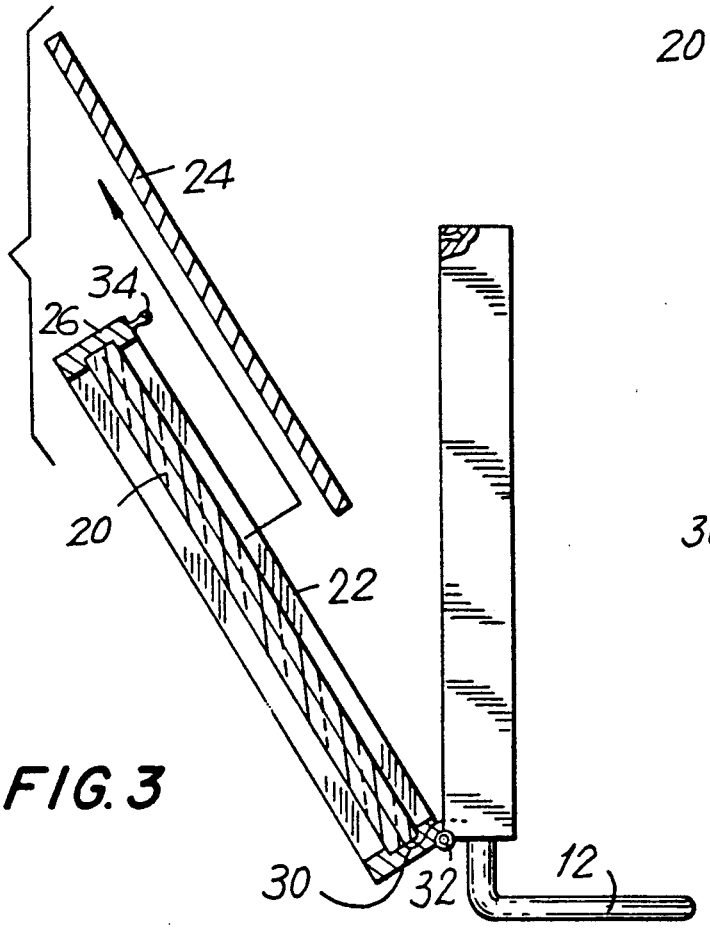
FIG. 3

TRANSPARENT DIAL FACE WATCH WITH REPLACEABLE VISUAL DISPLAY

BACKGROUND OF THE INVENTION

The present invention relates to watches, and more particularly, to watches having a transparent dial face, such as a liquid crystal dial face, which can both display the time and also retain therein aesthetically-pleasing visual items such as photographs.

Watches are a passion for people. The great demand for watches of all kinds has led to a variety of styles, shapes and colors employed to attract the consumer's interest. Moreover, in recent years, there has been a great demand for watches which serve additional functions beyond telling time. Thus, watches are now manufactured which possess a multiplicity of functions to suit a user's needs.

One such need among users is to have a watch which can also retain therein aesthetically-pleasing personal visual items such as small photographs or other memoranda. For example, U.S. Pat. No. 1,539,781 discloses a watch having a frame adjacent the dial face for displaying cards, photographs, etc. Needless to say, such a watch is bulky and cumbersome. U.S. Pat. No. 2,553,676 discloses a watch having a frame on the strap of the watch for viewing of a photograph or similar item. However, such a watch is aesthetically lacking and results in a cumbersome and unattractive watch.

Conventional watches are thus beset with difficulties when designed to incorporate therein visual display items such as those noted above, not the least of which are awkward designs, lack of compactness, lack of user choice by provision of a design of the manufacturer's choice on the dial face, etc.

Accordingly, the need still exists for a compact and attractive watch which can simultaneously display the time and visual items of the user's choice.

SUMMARY OF THE INVENTION

An object of the present invention is to provide a watch which can display the time as well as visually-pleasing display items of a user's choice, such as small photographs, simultaneously and in a compact manner.

A further object of the present invention is to provide a watch having a transparent dial face for displaying the time which can also simultaneously display visually-pleasing items of the user's choice through the transparent dial face.

These and other objects are achieved, in accordance with the present invention, by a watch constructed with a transparent front member, a rear watch mechanism for controlling the display of visually-perceptive indicia of time in the transparent front member, and means juxtaposed the transparent front member for retaining within the watch a visual display observable through the transparent front member simultaneously with the display of the time indicia. The retaining means is constituted of a compartment means arranged between the transparent front member and the rear watch mechanism for retaining the visual display within the watch in juxtaposed relation to the time indicia such that the visual display can be observed through the transparent front member simultaneously with the time indicia.

The watch of the present invention is also provided with means providing access to the compartment means, whereby a user can manually access the compartment means to remove, replace or adjust the visual display according to the user's choice.

BRIEF DESCRIPTION OF THE DRAWINGS

The invention will now be described and will be better understood by reference to the accompanying drawings, in which:

FIG. 1 is a perspective view of a first embodiment of a watch in accordance with the present invention;

FIG. 2 is a side elevation view partially in cross-section taken along the line 2—2 of FIG. 1;

FIG. 3 is a side elevation view similar to FIG. 2, illustrating the watch in an opened position;

DETAILED DESCRIPTION OF THE PREFERRED EMBODIMENTS

Figure 4:
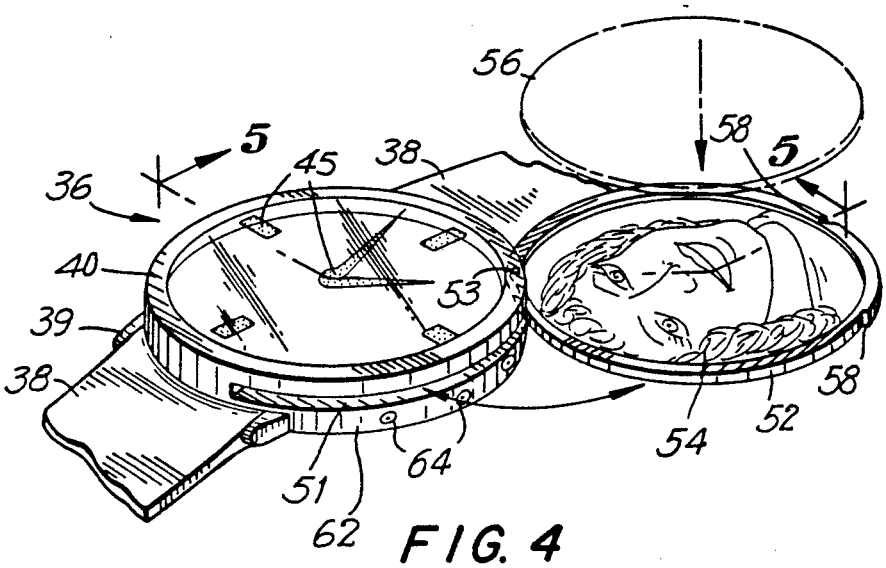
FIG. 4 is a perspective view of a second embodiment of a watch in accordance with the present invention in an opened position.

A first embodiment of a watch according to the present invention will now be described with reference to FIGS. 1 to 3.

As shown in FIGS. 1 to 3, a watch generally designated as 10 and mounted on a stand 12 for placement upright on a surface such as a table or desk is constituted of a front portion 13 and a rear portion 14.

Front portion 13 of watch 10 includes a transparent member 20 of, for example, liquid crystal material, and an interior hollow compartment 22 juxtaposed transparent member 20 for retaining therein a visual display item 24 of the user's choice, such as a small photograph. COmpartment 22 is defined and circumscribed by frame 26, which also circumscribes transparent member 20.

Rear portion 14 of watch 10 is mounted on stand 12, enclosed by frame 28, and contains a conventional watch mechanism. The watch mechanism (not shown) controls the display of visually-perceptive indicia of time 29 contained in transparent member 20 through control connection 30 passing through frame 26 to transparent member 20.

Frames 26 and 28 are connected at their base by hinge 32 and releasably held in captive engagement by closure 34. Closure 34 is a standard closure, for example, a snap closure. When closure 34 is manually opened, front portion 13 can be pivoted away from rear portion 14, thus exposing and providing access to compartment 22, whereby visual display item 24 may be inserted, removed, changed or adjusted as suits the user's need.

Once display item 24 is positioned within compartment 22 and closure 34 engaged to bring front and rear portions 13 and 14 into captive engagement, visual display item 24 can be observed through the transparent member 20 simultaneously with time indicia 29.

Compartment 22 thus functions as a means for retaining within the watch a visual display item 24 observable through the transparent member 20 in juxtaposed relation to time indicia 29.

A second embodiment of a watch according to the present invention will now be described with reference to FIGS. 4 and 5.

Figure 5:
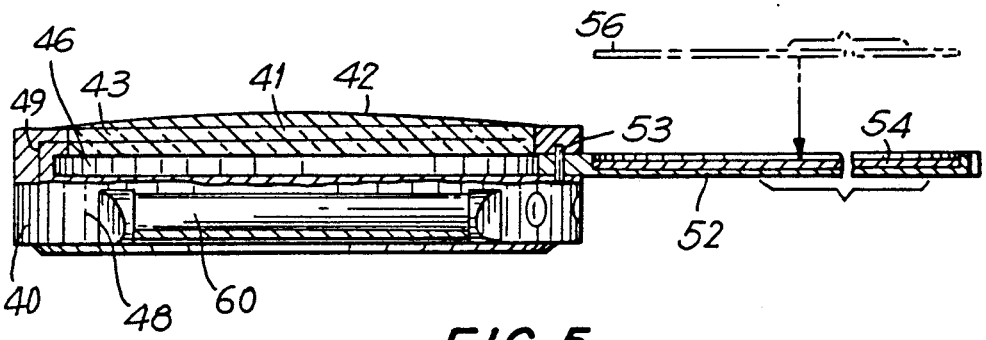
FIG. 5 is a side cross-sectional view taken along the line 5—5 of FIG. 4.

As shown in FIGS. 4 and 5, a watch generally referred to as 36 has a strap 38 attached to handles 39 on a frame 40 to constitute a wrist watch.

Transparent front portion 41 of watch 36 is constructed with a glass, plastic, or other transparent facing 42, a transparent member 43 such as liquid crystal material, visually-perceptive indicia of time 45, and a hollow compartment 46 located immediately behind transparent member 43.

Rear portion 48 of watch 36 contains a conventional and well-known watch mechanism (not shown) for controlling the display of time indicia 45 through control connection 49, passing from the watch mechanism through frame 40 to transparent member 43.

Transparent member 43, hollow compartment 46 and rear watch mechanism 48 are all enclosed by cylindrical frame 40 having a slot opening 51 therein adjacent compartment 46 for providing access to compartment 46. A mounting plate or tray 52 is pivoted to frame 40 at pivot 53, whereby mounting plate 52 can be pivoted into and out of compartment 46 as desired.

Accordingly, a user can place a visual display item 54 of choice on mounting plate 52 and manually pivot the mounting plate 52 into compartment 46. A transparent cover 56 made, for example, of thin plastic or glass, can be provided for placement over visual display item 54 before pivoting of plate 52 into compartment 46 for protection of the display item. A grasp 58 is provided on the periphery of mounting plate 52 to facilitate pivoting.

Once mounting plate 52 with display item 54 is pivoted into compartment 46, display item 54 can be observed visually through transparent facing 42 and transparent member 43 simultaneously with and in juxtaposed relation to time indicia 45.

Frame 40 is also provided with an additional slot 60, a cover plate 62 and securing means such as screws 64 for securing cover plate 62 over slot 60. Slot 60 provides access to the watch mechanism in rear portion 48 of watch 36 for servicing.

Figure 6:
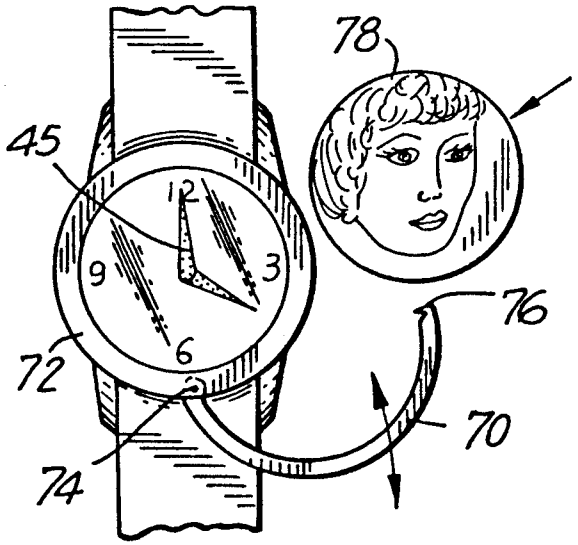
FIG. 6 is a top plan view of a third embodiment of a watch in accordance with the present invention, in an opened position.

Another embodiment of the watch of the present invention is shown in FIG. 6. In this embodiment, the watch is substantially similar to the embodiment of FIGS. 4 and 5. However, a door means in the form of a curved arm 70 is pivoted to frame 72 at pivot 74 instead of the mounting plate or tray 52. Curved arm 70 has a shape conforming to the periphery of frame 72, such that when curved arm 70 is closed, its other surface conforms to the smooth cylindrical outer surface of frame 72. When closed, curved arm 70 is secured in place, for example, by a conventional hook-and-eye 76 formed on the outer tip of curved arm 70 and the main body of frame 72.

In operation, curved arm 70 is opened, visual display item 78 is slid into compartment 46, which is identical to compartment 46 in the embodiment of FIGS. 4 and 5, and curved arm 70 is then closed and secured in place by hook-and-eye 76. Visual display item 78 can thus be observed, as in the preceding embodiments, through the facing and transparent liquid crystal member of the front portion of the watch.

Alternatively, visual display item 78 can be mounted on a separate mounting plate, identical to mounting plate 52 of the FIG. 4 and 5 embodiment except that it is not pivoted or attached in any manner to the frame of the watch, and the mounting plate with visual display item thereon slid or otherwise moved into place in the hollow compartment of the watch, after which curved arm 70 is closed and secured in place.

Figure 7:
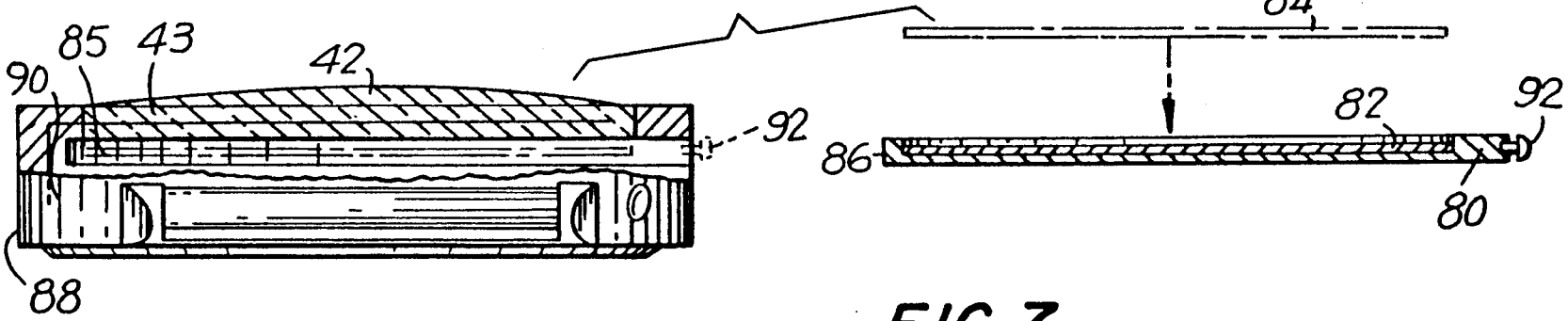
FIG. 7 is a fragmented side view of a fourth embodiment of a watch in accordance with the present invention.

Yet another embodiment of the present invention is shown in FIG. 7. This embodiment is like the embodiments of FIGS. 4 to 6 in all respects, except that, rather than a mounting plate 52 or curved arm 70, there is provided a mounting plate 80 which is completely detachable from the watch itself. A visual display item 82 is mounted on the mounting plate 80, a transparent cover 84 provided thereover if desired, and the assembly slid or otherwise inserted into hollow compartment 85 of the watch. MOunting plate 80 has a peripheral surface 86 which conforms to the peripheral surface 88 of frame 90 of the watch, to provide a smooth outer peripheral surface to the entire frame of the watch. A screw 92 or other securing means is provided on peripheral surface 86 to secure mounting plate 80 in place after insertion into hollow compartment 85.

As in the preceding embodiments, after insertion into compartment 85, visual display item 82 is observable to the eye through the transparent facing and liquid crystal member of the front portion of the watch.

It will thus be appreciated that, in accordance with the present invention, a watch is provided which not only displays time indicia in a transparent member such as a liquid crystal member, but also simultaneously permits display of a visual display item of the user's choice through the transparent member in juxtaposed relation to the time indicia. The present invention thus provides a very compact and attractive watch. There is no need to provide excessive watch surface to display time indicia and visual display items of the user's choice side-by-side. Nor is it necessary to require opening or other adjustment of the watch to view a visual display item contained therein. The convenient replaceability of the visual display item by the user provides choice for the user and does not limit the user to any visual display which may be incorporated into conventional watches by a manufacturer.

It will be understood that the specification and preferred embodiments are illustrative but not limitative of the present invention. Other embodiments within the spirit and scope of the invention will suggest themselves to those skilled in the art. For example, while the watches shown in the embodiments of FIGS. 4 through 7 are illustrated as cylindrical in shape, any watch shape may be employed and the corresponding compartment means and access means shaped accordingly. Similarly, while the watch of the embodiment illustrated in FIGS. 1 through 3 is square-shaped, any shape watch may be used and the compartment means shaped in a corresponding and appropriate manner.

Having thus described my invention, what I claim and desire to secure by Letters Patent, is:

1. A watch comprising a transparent front member, visually-perceptive liquid crystal indicia of time contained in said transparent front member, rear watch stemless mechanism means for controlling the liquid crystal display of said visually-perceptive indicia of time in said transparent front member, and means in juxtaposed relation with said transparent front member for retaining within said watch a visual display observable through said transparent front member and liquid crystal indicia, said retaining means comprising unobstructed stem free compartment means arranged between said transparent front member and said rear watch mechanism means for freely receiving and retaining said visual display in juxtaposed relation to said visually-perceptive indicia of time, whereby said display can be observed through said transparent front member simultaneously with said visually-perceptive indicia of time.

2. A watch according to claim 1, further comprising a means for accessing said compartment means, whereby a user can manually access said compartment means to remove, change or adjust said visual display.

3. A watch according to claim 2, said access means comprising means for pivoting said transparent front member into and out of engagement with said rear watch mechanism means, whereby a user can manually access said compartment means when said transparent front member is pivoted out of engagement with said rear watch mechanism means.

4. A watch according to claim 2, said access means comprising frame means surrounding said transparent front member and door means in said frame means adjacent said compartment means, said door means permitting access to said compartment means when opened.

5. A watch according to claim 4, wherein said door means comprises curved arm means, said curved arm means forming a portion of a peripheral surface of said frame means, and further comprising means for pivoting said door means to open and close said compartment means.

6. A watch according to claim 2, said access means comprising frame means surrounding said transparent front member and slot means in said frame means adjacent said compartment means, said slot means permitting access to said compartment means.

7. A watch according to claim 6, further comprising plate means for removably mounting said visual display thereon, and pivot means connected to said frame means for pivoting said plate means into and out of said compartment means through said slot means.

8. A watch according to claim 7, further comprising transparent cover means for covering said visual display after said visual display has been mounted on said plate means.

9. A watch according to claim 6, further comprising plate means for removably mounting said visual display thereon, said plate means being movable into and out of said compartment means through said slot means.

10. A watch according to claim 7, further comprising means for locking said plate means in place when said plate means is pivoted into said compartment means.

11. A watch according to claim 1, said transparent front member comprising a liquid crystal.

12. A watch according to claim 1, further comprising stand means for holding said watch upright on a surface.

13. A watch according to claim 1, further comprising strap means for wearing said watch on a wrist.

14. A watch according to claim 1, further comprising first frame means surrounding said rear watch mechanism means, and second frame means surrounding said transparent front member and said compartment means.

15. In a watch of the type wherein visually-perceptive liquid crystal indicia of time are provided in a transparent front member, and the display of said visually-perceptive indicia of time is controlled by a stemless watch mechanism, the improvement comprising means in juxtaposed relation with said transparent front member for retaining within said watch a visual display observable through said transparent front member and liquid crystal indicia, said retaining means comprising unobstructed stem free compartment means arranged between said transparent front member and said rear watch mechanism for retaining said visual display in juxtaposed relation to said visually-perceptive indicia of time, whereby said visual display can be observed through said transparent front member simultaneously with said visually-perceptive indicia of time.

16. A watch according to claim 15, the improvement further comprising means for accessing said compartment means, whereby a user can manually access said compartment means to remove, change or adjust said visual display.

17. A watch according to claim 16, said access means comprising means for pivoting said transparent front member into and out of engagement with said watch mechanism, whereby a user can manually access said compartment means when said transparent front member is pivoted out of engagement with said watch mechanism.

18. A watch according to claim 16, said access means comprising frame means surrounding said transparent front member, door means in said frame means adjacent said compartment means, and means for pivoting said door means to open and close said compartment means.

19. A watch according to claim 16, said access means comprising frame means surrounding said transparent front member and slot means in said frame means adjacent said compartment means, said slot means permitting access to said compartment means.

20. A watch according to claim 19, further comprising plate means for removably mounting said visual display thereon, said plate means being movable into and out of said compartment means through said slot means.

* * * * *